US008783318B2

(12) United States Patent
Witkiewicz

(10) Patent No.: US 8,783,318 B2
(45) Date of Patent: Jul. 22, 2014

(54) WRAPPER ASSEMBLY

(75) Inventor: Adam Witkiewicz, Elkhorn, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 467 days.

(21) Appl. No.: 13/185,832

(22) Filed: Jul. 19, 2011

(65) Prior Publication Data

US 2013/0019565 A1 Jan. 24, 2013

(51) Int. Cl.

| | |
|---|---|
| ***B65B 13/04*** | (2006.01) |
| ***B65B 13/10*** | (2006.01) |
| ***B65C 3/02*** | (2006.01) |
| ***B65C 3/04*** | (2006.01) |
| ***B65C 9/32*** | (2006.01) |
| ***B65H 81/02*** | (2006.01) |

(52) U.S. Cl.

USPC ..... 156/443; 156/446; 156/475; 100/27; 53/588; 53/138.6; 53/138.7; 53/139.1

(58) Field of Classification Search

CPC ..... B65B 11/00; B65B 13/04; B65B 13/10; B65C 3/02; B65C 3/04; B65C 9/32; B65H 81/02; B65H 81/06

USPC ..... 156/443, 446, 475; 100/27; 53/138.6, 53/138.7, 139.1, 203, 210, 211, 216, 588

See application file for complete search history.

(56) References Cited

U.S. PATENT DOCUMENTS

| | | | | |
|---|---|---|---|---|
| 3,547,737 | A | 12/1970 | Vici | |
| 4,602,976 | A | 7/1986 | Fukuda et al. | |
| 5,355,787 | A | 10/1994 | Burns et al. | |
| 5,954,918 | A | 9/1999 | Belivakici | |
| 6,875,304 | B2 | 4/2005 | Schanke et al. | |
| 6,986,376 | B1 * | 1/2006 | Kim | 156/555 |
| 7,469,736 | B2 | 12/2008 | Fries et al. | |
| 7,717,149 | B2 | 5/2010 | Johnson | |
| 7,757,739 | B2 | 7/2010 | Fries et al. | |
| 2004/0206459 | A1 * | 10/2004 | Schanke et al. | 156/443 |
| 2004/0211522 | A1 * | 10/2004 | Fries et al. | 156/443 |
| 2006/0037709 | A1 | 2/2006 | Itoh | |

FOREIGN PATENT DOCUMENTS

| | | | |
|---|---|---|---|
| EP | 1832519 | A1 | 9/2007 |
| EP | 2058231 | A1 | 5/2009 |
| JP | 57011740 | A | 1/1982 |
| JP | 2008037479 | A | 2/2008 |

OTHER PUBLICATIONS

PCT International Search Report for corresponding PCT application No. PCT/US2012/046710, mailed Oct. 30, 2012, 5 pages.

* cited by examiner

*Primary Examiner* — George Koch
(74) *Attorney, Agent, or Firm* — Quarles & Brady LLP

(57) ABSTRACT

A wrapper assembly is disclosed that can be used, for example, to wrap a label around a wire. In the wrapper assembly, a pair of supports are spaced apart from one another and a plurality of rollers are disposed there between. The wrapper assembly further includes at least one yoke. Both the pair of supports and the yoke have positioning slots formed therein that support the rollers. By moving the yoke or yokes relative to the supports, the positioning slots in the yoke or yokes shifts relative to the positioning slots in the supports and thereby adjusting the positions of rollers relative to one another.

18 Claims, 6 Drawing Sheets

WRAPPER ASSEMBLY

CROSS-REFERENCE TO RELATED APPLICATIONS

Not applicable.

STATEMENT OF FEDERALLY SPONSORED RESEARCH OR DEVELOPMENT

Not applicable.

BACKGROUND

This disclosure relates to an assembly for gripping and rotating objects. In particular, this disclosure relates to a wrapper assembly that facilitates the wrapping of a label around a slender object such as, for example, a printed label around a wire.

Various devices and machines have been developed for the application of labels to wires and other slender objects. Typically, such machines grasp two ends of a section of the wire and pull this section of wire taut. Once the wire is pulled taut, a label applicator or platform orbits around the taut section of wire to apply the label to the wire. This label applicator must be capable of orbiting around the wire while applying an appropriate amount and type of pressure between the label applicator and the wire. Because the wire or object to be wrapped may take on various shapes or sizes, this can complicate the design and operation of such wire wrappers.

Accordingly, these conventional wire wrapping machines are very complex in terms of parts and operation. Separate components are necessary for straightening, centering, and clamping. Moreover, sufficient space must be allotted in the machine to accommodate the orbiting of the label applicator about the wire. Frequently, this means the use of such wire wrappers are limited to immovable fixtures or devices that are not well-adapted for portable use.

Hence, a need exists for an improved wrapper assembly and, in particular, for a wrapper assembly that is compact and simple in its mode of operation.

SUMMARY OF THE INVENTION

An assembly is disclosed having a structure and a style of operation that differs from conventional wire wrapping mechanisms. This new structure can be much more compact and reduces the number of components in the assembly without impairing functionality. Accordingly, such an assembly is well-suited for use in a portable device.

According to one form of the invention, a wrapper assembly includes a pair of supports spaced apart from one another. In each of the pair of supports, positioning slots are formed. A plurality of rollers are disposed between the pair of supports and are supported by the positioning slots in the pair of supports such that the plurality of rollers have axes that are substantially parallel with one another. The wrapper assembly also includes at least one yoke having positioning slots formed in the yoke. The positioning slots in the yoke also support at least some of the plurality of rollers. The yoke or yokes are translationally movable relative to the pair of supports to shift the positioning slots in the yoke(s) relative to the positioning slots in the pair of supports. The intersection of the adjacent positioning slots in the yoke(s) and supports defines the axes of rotation of the rollers in a direction essentially perpendicular to the plane of translation. Accordingly, the movement or shifting of the yoke(s) relative to the supports may be used alter a position of at least some of the plurality of rollers relative to one another.

The plurality of rollers may be movable between a closed position and an open position. When the plurality of rollers are between the closed position and the open position, the plurality of rollers may be configured to capture an object centrally disposed there between. To help the rollers capture or clamp down on a centrally disposed object, the wire wrapper may include one or more biasing elements that engage the yoke(s). Such biasing element(s) may be configured to bias the yoke(s) towards the closed position. Although various types of biasing elements might be used, in one preferred form the biasing element may be an extension spring.

In the context of the larger wrapper assembly, the pair of supports, the plurality of rollers, and the yoke may comprise a rotatable subassembly. The wrapper assembly may include a frame into which the rotatable subassembly is received. In this form, the pair of supports may be discs and the frame may receive the discs. The discs may bear directly on the frame or an intermediate object (such as a bushing or the like) that may be interposed between the discs and the frame.

Each of the pair of supports or discs may include a notch that generally extends from a center of the support or disc to a periphery of the support or disc. Likewise, the yoke(s) may include a corresponding notch. Together, these notches accommodate for the insertion or positioning of a wire or other object along the central rotational axis of the rotatable subassembly and in between the rollers. When the rotatable subassembly is placed within a frame, the frame also may include at least one opening that aligns with the notches in at least one rotation position of the rotatable subassembly in the frame. In this position, a section of wire or another item may be received into the rotatable subassembly by radially inserting a section of the wire into the notches of supports and yokes and opening in the frame. Accordingly, the wire does not need to be axially threaded through the rotatable subassembly.

In some forms, a worm wheel may be coupled to the rotatable subassembly and the wrapper assembly may further include a worm gear configured to drive the worm wheel. The worm gear may be selectively powered by a motor or the like to axially rotate the worm gear and drive the worm wheel, thereby causing the rotation of the rotatable subassembly.

A plurality of spacers may couple the pair of supports to one another. Whereas the plurality of rollers between the supports are movable relative to the supports to capture a wire or another object, the spacers can serve as rigid elements to establish the support-to-support distance.

In one embodiment, the wire wrapper may include a pair of yokes. One of the pair of yokes may be disposed proximate to each end of the plurality of rollers.

Some of the plurality of rollers may include dowel rods extending from their axial ends. Such dowel rods can be of a diameter less than the diameter of the roller to which it is attached. These dowel rods can then be received in the positioning slots of the pair of supports and the yoke or yokes. In one form, these dowel rods may be press fit into the ends of the rollers.

Although the positioning slots may take different forms, in one embodiment the positioning slots on each of the pair of supports may include a pair of collinear slots and a slot that is perpendicular to the pair of collinear slots and the yoke(s) may include a pair of linear slots that are at an angle relative to one another. In this embodiment, the pair of collinear slots in the pair of supports and the pair of linear slots that are at an angle relative to one another in the yoke(s) may form a pair of intersections that thereby define axes for two of the plurality of rollers. One of the pair of rollers, which is different from the two rollers having axes defined by the intersections of the positioning slots, may be configured to translationally move with the yoke(s) and may be further guided or supported by the slot that is perpendicular to the pair of collinear slots.

In one embodiment of the invention, there may be three rollers. The positional slots may be configured such that, when the at least one yoke is moved to alter the axes of the three rollers relative to one another along a plane that is perpendicular to the axes of the three rollers, circles having a circumference defined by the intersection of the axes with the plane will be concentric with one another.

These and still other advantages of the invention will be apparent from the detailed description and drawings. What follows is merely a description of a preferred embodiment of the present invention. To assess the full scope of the invention, the claims should be looked to as the preferred embodiment is not intended to be the only embodiment within the scope of the claims.

DETAILED DESCRIPTION OF A PREFERRED EMBODIMENT

Figure 1:
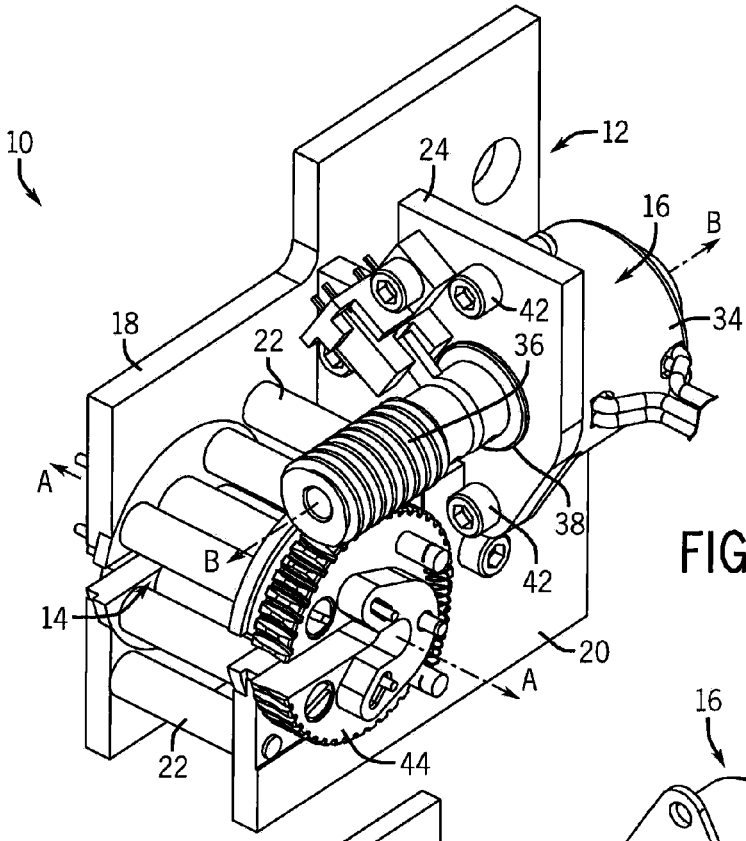
FIG. 1 is a perspective view of the wrapper assembly.
Figure 2:
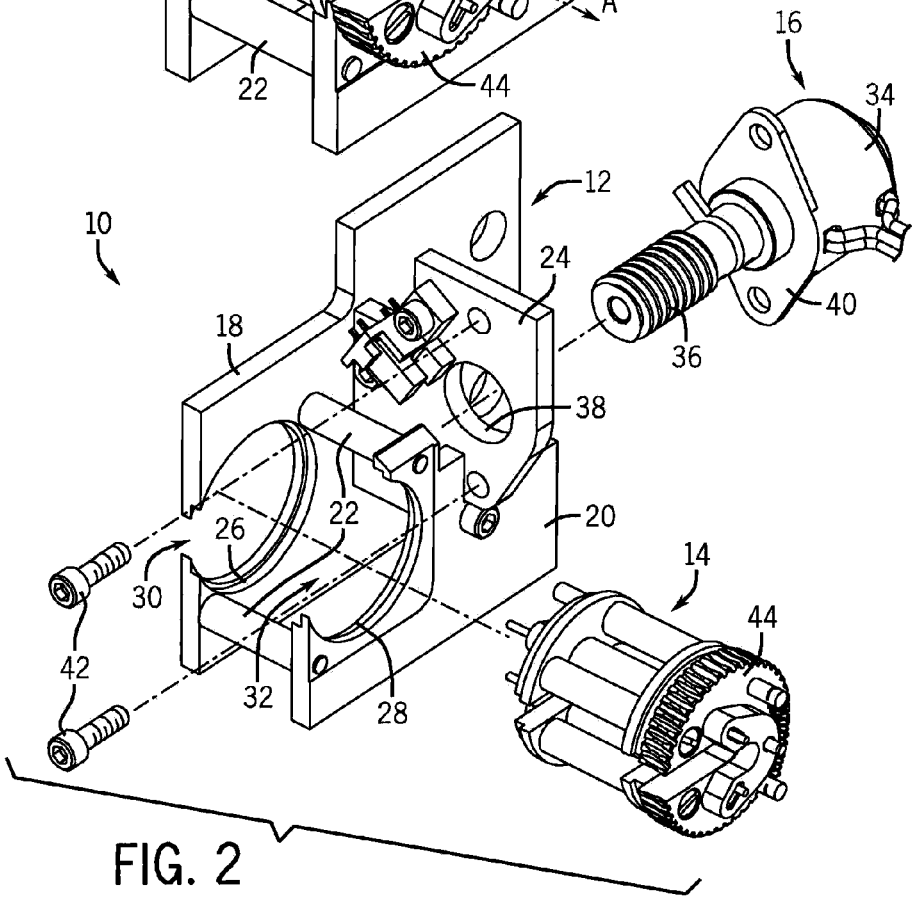
FIG. 2 is an exploded perspective view of the wrapper assembly of FIG. 1 in which the rotatable subassembly and the motor are exploded from the frame.
Figure 3:
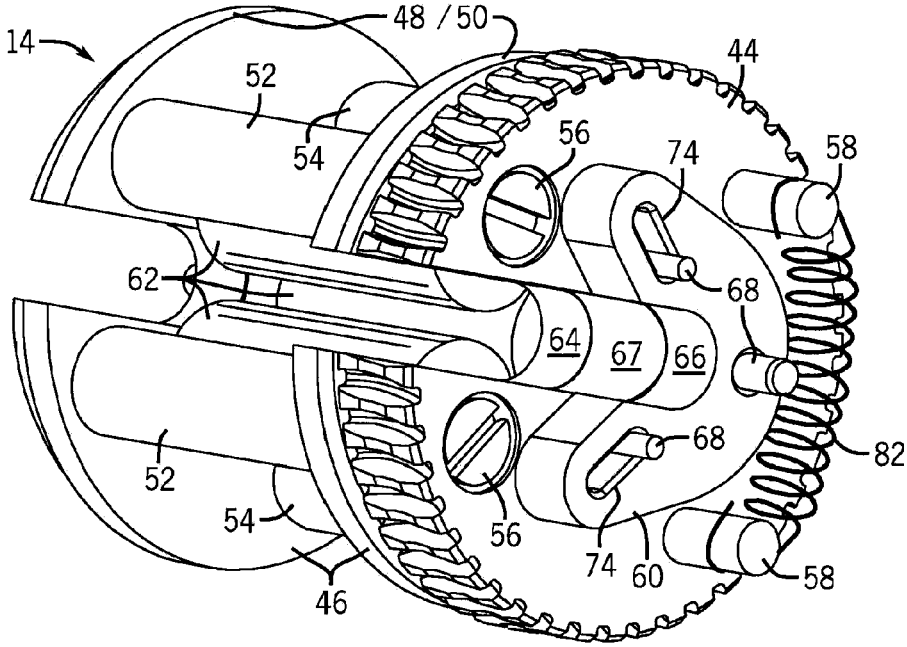
FIG. 3 is a front side view of the rotatable subassembly.
Figure 4:
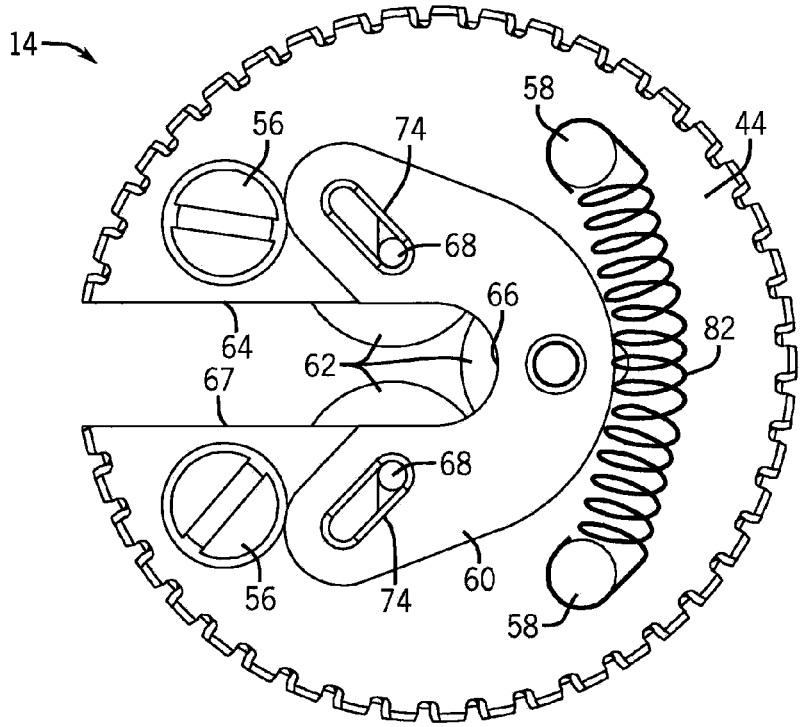
FIG. 4 is a right side view of the rotatable subassembly of FIG. 3.

Referring first to FIGS. 1 and 2, a wrapper assembly 10 for capturing a wire and then wrapping a label around the wire is illustrated. In the form shown, the wrapper assembly 10 is part of a fixture. However, this is just one exemplary embodiment and the wrapper assembly 10 could be part of a larger device such as, for example, a printer or a portable device.

To summarize the general construction and operation of the wrapper assembly 10, the wrapper assembly 10 includes a frame 12 that supports a rotatable subassembly 14. The rotatable subassembly 14 is configured to receive a wire or another slender object. When the wire or other object is received in the rotatable subassembly 14, then the rotatable subassembly 14 may be rotated about an axis of rotation A-A by a driving mechanism 16, which is also supported by the frame 12, and a label or other item may be affixed to the wire.

As indicated above, the frame 12 supports the other components in the wrapper assembly 10. The frame 12 includes a pair of side walls 18 and 20 which are spaced apart from one another by spacers 22 and a connecting wall 24. The two side walls 18 and 20 are parallel with one another while the connecting wall 24 is perpendicular to the two side walls 18 and 20.

The two side walls 18 and 20 have a pair of bearing surfaces 26 and 28, respectively, formed therein that receive and support the rotatable subassembly 14. As best seen in FIG. 2, the bearing surfaces 26 and 28 are semi-circular counterbored openings that have a diameter on the laterally inward portion of the wall that is larger than a diameter on the laterally outward portion of the wall. Because the portions of the rotatable subassembly 14 that are received into these bearing surfaces 26 and 28 are also stepped, the counterboring of the bearing surfaces 26 and 28 restricts the axial movement of the rotatable subassembly 14 along axis A-A.

Additionally, it should be observed that these bearing surfaces 26 and 28 do not form closed circles or loops, which means that openings 30 and 32 and are provided in each of the two side walls 26 and 28. These openings 30 and 32 allows the insertion of a wire into the rotatable subassembly 14 through the frame 12 without having to thread the wire axially through the rotatable subassembly 14.

Also supported by the frame 12 is the driving mechanism 16, which includes an electric motor 34 that drives a worm gear 36 via an output shaft (not shown). In the specific form illustrated, an opening 38 is formed in the connecting wall 24 of the frame 12. The worm gear 36 is inserted through the opening 38 in the connecting wall 24 until a flange 40 on the motor 34 abuts the connecting wall 24. Fasteners 42 are then used to connect the motor 34 to the connecting wall 24. When the motor 34 is mounted, the worm gear 36 is positioned to extend along an axis of rotation B-B that is perpendicular to the rotational axis A-A of the rotatable subassembly 14.

In the form illustrated, the teeth of the worm gear 36 engage the teeth of a worm wheel 44 on the rotatable subassembly 14. When the worm gear 36 is driven to rotate the worm gear 36 about its axis of rotation B-B, the rotational motion of the worm gear 36 is transmitted to the worm wheel 44 to drive the rotation of the rotatable subassembly 14 along a perpendicular axis of rotation to axis B-B.

Although a drive train including a worm gear 36 and worm wheel 44 is illustrated, other driving mechanisms may be used including, but not limited to, belts, other types of gears (e.g., spur gears) and other gear configurations. Likewise, although an electric motor 34 is described, other type of prime movers or power sources may be used or the rotatable subassembly 14 could be rotated using energy supplied by the end user (e.g., by manual cranking).

Moreover, although the worm wheel 44 is illustrated as being a separate component in the rotatable subassembly 14, it should be appreciated that the worm wheel 44 (or other drive component) could be integrally formed with another component of the rotatable subassembly 14 such as, for example, one of the pair of supports 46 described below.

Now with reference to FIGS. 3 through 7, the various components of the rotatable subassembly 14 are shown in greater detail.

Figure 6:
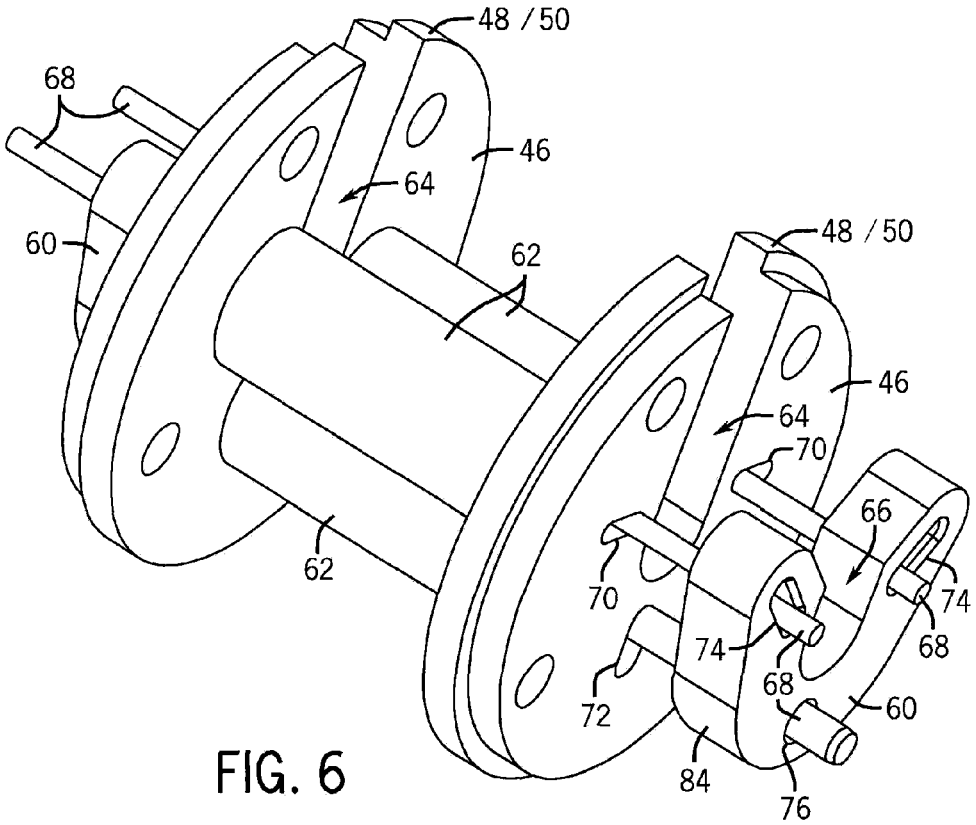
FIG. 6 is a partially exploded perspective view of the rotatable subassembly in which the orientation of the positioning slots is illustrated on the disc and yoke. For purposes of clarity, the spacers and the worm wheel are not illustrated in this view.
Figure 7:
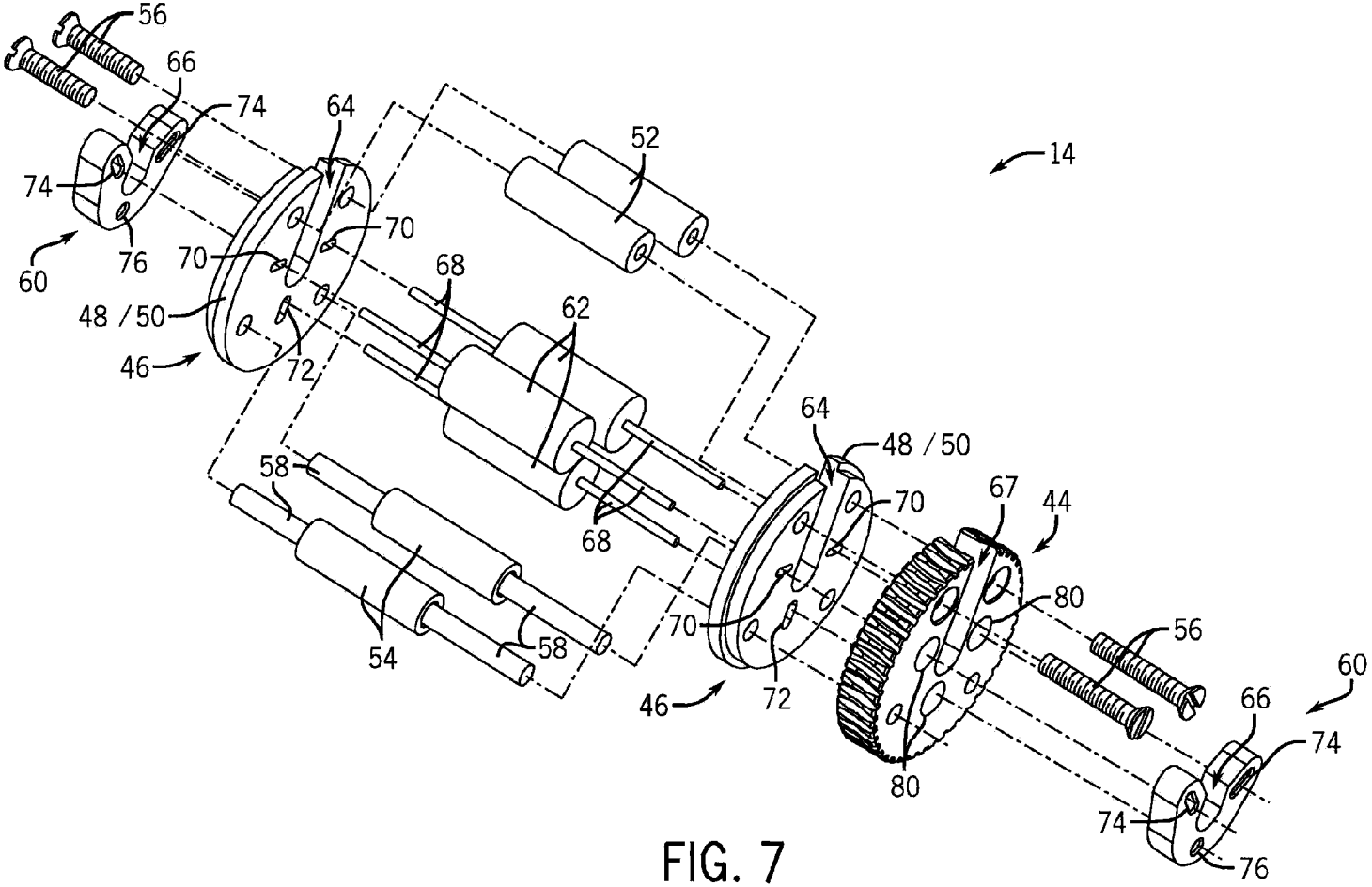
FIG. 7 is an exploded perspective view of the rotatable subassembly.

The rotatable subassembly 14 includes a pair of supports 46 which are spaced apart from one another. In the form shown, these supports 46 are circular discs. As best depicted in FIGS. 6 and 7, each of the supports 46 have a stepped periphery 48 that provide bearing surfaces 50 which mate with and bear on the semi-circular bearing surfaces 26 and 28 of the frame 12. However, the pair of supports 46 do not need to bear directly on the frame 12; in alternative forms, separate bushings or bearings may be provided between the frame 12 and the pair of supports 46 to enable the smooth rotation of the rotatable subassembly 14 relative to the frame 12.

The distance between the pair of supports 46 is established by placing pairs of spacers 52 and 54 between the supports 46 and coupling the spacers 52 and 54 to the supports 46. Some of the spacers 52 are rigidly attached to the supports 46 or other components of the rotatable subassembly 14 (such as the worm wheel 44) using fasteners such as screws 56. Still other of the spacers 54 are attached by press fitting the axial ends 58 of the spacers 54 into openings in the supports 46 and/or the worm wheel 44 which, in the form shown, is disposed adjacent to and axially outward of one of the supports 46. For the press fit spacers 54, the axial ends 58 of these spacers 54 may extend through the supports 46 and/or the worm wheel 44 to serve as posts for other types of mechanical attachment, as will be described in greater detail below.

Figure 5:
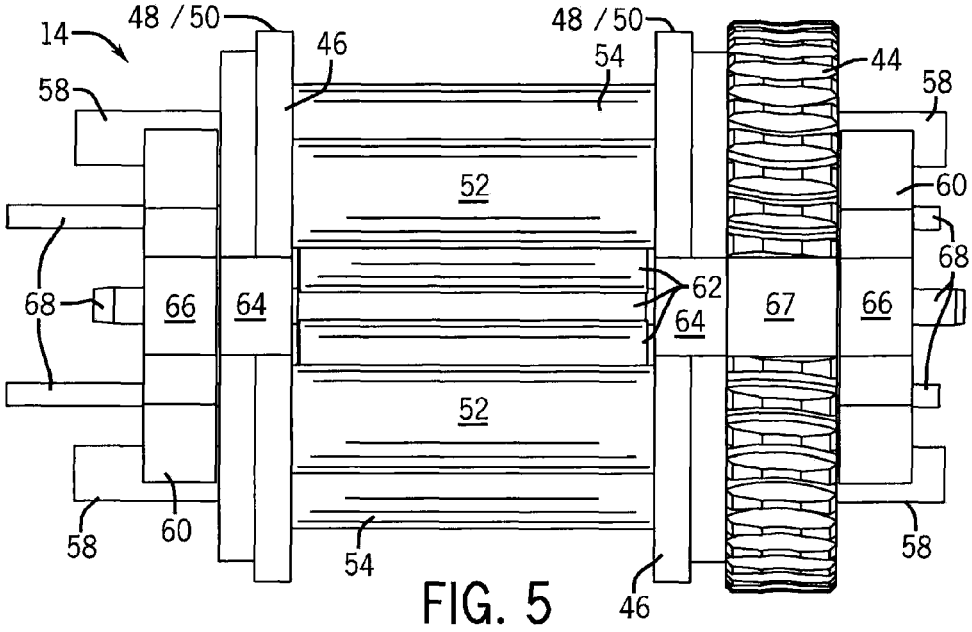
FIG. 5 is a front view of the rotatable subassembly of FIG. 3.

The rotatable subassembly 14 also includes a pair of yokes 60 which are generally U-shaped and that, as best seen in FIGS. 5 through 7, are disposed axially outward of the supports 46. On the side of the rotatable subassembly 14 having the worm wheel 44, the yoke 60 is also positioned axially outward of both the support 46 and the worm wheel 44.

Each of the yokes 60 are movable relative to the pair of supports 46 in a direction perpendicular to the axis of rotation A-A of the rotatable subassembly 14. As will be described in further detail below, this translational movement of the yoke 60 relative to the supports 46 assists in actuating and positioning a plurality of rollers 62 disposed between the supports 46 in order to capture a wire or another slender object between the rollers 62.

To provide clearance for the insertion of the wire or object into the rotatable subassembly 14, linearly-aligned notches 64 and 66 are provided in the supports 46 and the yokes 60, respectively. The notch 64 in each of the supports 46 extends from approximately the center of the support 46 to the periphery 48 of the support 46, whereas the notches 66 in the yokes 60 are defined by the central part of their U-shaped body. A notch 67 is also formed in the worm wheel 44, which is aligned with the notch 64 in one of the supports 46.

It should be appreciated that, even when the yokes 60 are moved relative to the supports 46, their movement is limited in such a way that the notches 64, 66 and 67 continue to be linearly aligned with one another and lie along the same plane, although the ends of the notches 64 and 66 may move relative to one another. In at least one rotational position (such as, for example, the rotational position illustrated in FIG. 1), the notches 64, 66, and 67 align with the openings 30 and 32 in the frame 12 such that a wire or other object can be radially inserted into the center of the rotatable assembly 14.

Notably, a plurality of rollers 62 are disposed between the pair of supports 46. The rollers 62 are movable relative to one another and may be used to clamp or capture an object centrally disposed there between, such as a wire. These rollers 62 have axes that are substantially parallel with one another even when the rollers 62 are moved relative to one another, as will be described in more detail below. In the form shown, there are a total of three rollers; however, it is contemplated that there may be more than the three rollers.

As best seen in FIG. 7, each of the rollers 62 have axial ends 68 (e.g., dowel rods) of a reduced diameter (in comparison to the central body of the rollers 62) which are received in positioning slots or openings in the supports 46 and the yokes 60. Each one of the axial ends 68 of the rollers 62 are received in a set of positioning slots and/or openings, in which one of the set is found in the support 46 and one of the set is found in the yoke 60. Because the positioning slots/openings in the supports 46 are differently patterned from the positioning slots/openings in the yokes 60, the relative location of the axes of the rollers 62 can be moved, adjusted, or otherwise altered relative to one another by moving or shifting the yokes 60 relative to the supports 46.

The positioning slots are patterned as follows. The positioning slots on each of the pair of supports 46 includes a pair of collinear slots 70 and a slot 72 that is perpendicular to the pair of collinear slots 70. In the yokes 60, the two legs of the "U" have a pair of linear slots 74 that are at an angle relative to one another. There is also an opening 76 at the bottom of the U-shaped part of each of the yokes 60. Additionally, the worm wheel 44 has a set of pass-through circular apertures 80 which generally correspond with positions of the adjacent positioning slots on the yokes 60 and supports 46, but which, at least in the form shown, do not particularly limit or define to axes of the rollers 62.

In the form illustrated, there are three rollers 62, two of which are differently supported than the other one. One of these rollers 62 is received in the openings 76 at the bottom of the U-shaped part of each of the yokes 60 and in the perpendicular slots 72 in the each of the supports 46. Because there is little no clearance between the axial ends 68 of this roller and the opening 76 in the yoke 60, this roller moves with the yokes 60 in a linear direction which, as illustrated, is also in a radial direction. The other two rollers have axes defined by the intersections of the collinear slots 70 in the supports 46 and the angled linear slots 74 in the yokes 60.

Accordingly, as best seen in FIGS. 8 through 11, when the yokes 60 move or shift relative to the supports 46, one of the rollers moves with yoke 60 while the axes of the other two rollers move based on the changing intersection of the collinear slots 70 in the support 46 and the angled linear slots 74 in the yoke 60 to change the position of the axes of the rollers 62 relative to one another.

Figure 8:
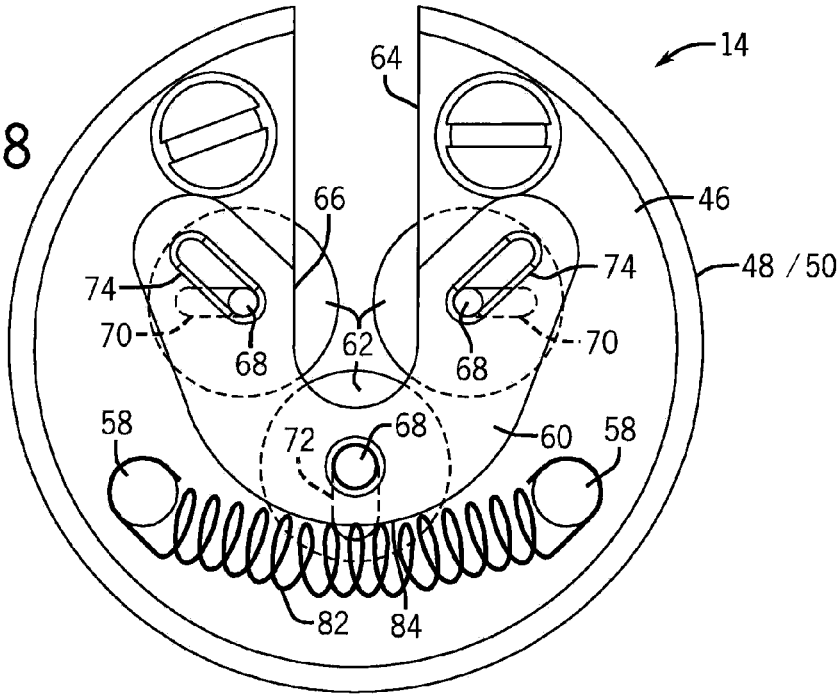
FIG. 8 is a left side view of the rotatable subassembly in a closed position.
Figure 9:
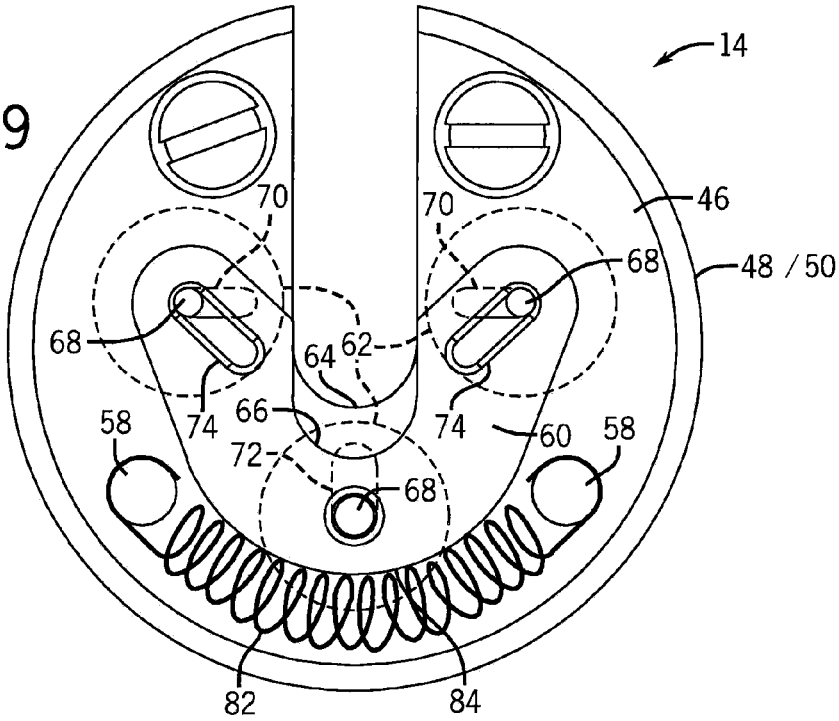
FIG. 9 is a left side view of the rotatable subassembly in a fully open position.

Comparing FIGS. 8 and 9, the rotatable subassembly 14 is shown in which the plurality of rollers 62 are in a closed position and an open position, respectively. In the closed position of FIG. 8, the yoke 60 is shifted forward or upward (i.e., so the bottom of the "U" of the yoke 60 is shifted toward the central axis A-A, but in which the legs of the "U" continue to straddle the axis A-A) and in being so positioned, causes the axes of the rollers 62 to be shifted centrally inward toward axis A-A. In the open position of FIG. 9, the yoke 60 is shifted backward or downward to move the axes of all of the rollers 46 away from the central axis A-A.

In one particularly advantageous configuration, when the yokes 60 are moved to alter the position of the axes of the rollers 62, the points of intersection between the axes of the rollers 62 and a plane perpendicular to the axes may define a circle. The positioning slots in the supports 46 and the yokes 60 may be so defined as to make the circles formed at the various positions of the yokes 60 relative to the supports 46 concentric with one another. In this way, the center point of an item (such as a wire) captured between the rollers 62 can be similar regardless of the size of the item being captured.

A biasing element 82 may be used to bias the yoke 60 toward the closed position. In the form illustrated, the biasing element 82 is an extension spring that is connected between two posts formed by the axial ends 58 of two of the spacers 54 that extend through and out of the worm wheel 44. The two ends of the extension spring are attached to the posts and the coiled body of the extension spring, in an attempt to compress by shortening its length, abuts a bottom surface 84 of the yoke 60. This creates the biasing force that biases the yoke 60 upward toward the position shown in FIG. 8. Although an extension spring is illustrated, it will be readily appreciated that other types of biasing elements could be used including, but not limited to, springs, clips, hydraulic elements, electrical and/or magnetic elements, and so forth. Likewise, the biasing element might be replaced with some other type of actuator, either automatic or manually implemented, to selectively move the rollers 62 toward the closed position to grip a centrally-disposed item.

Figure 10:
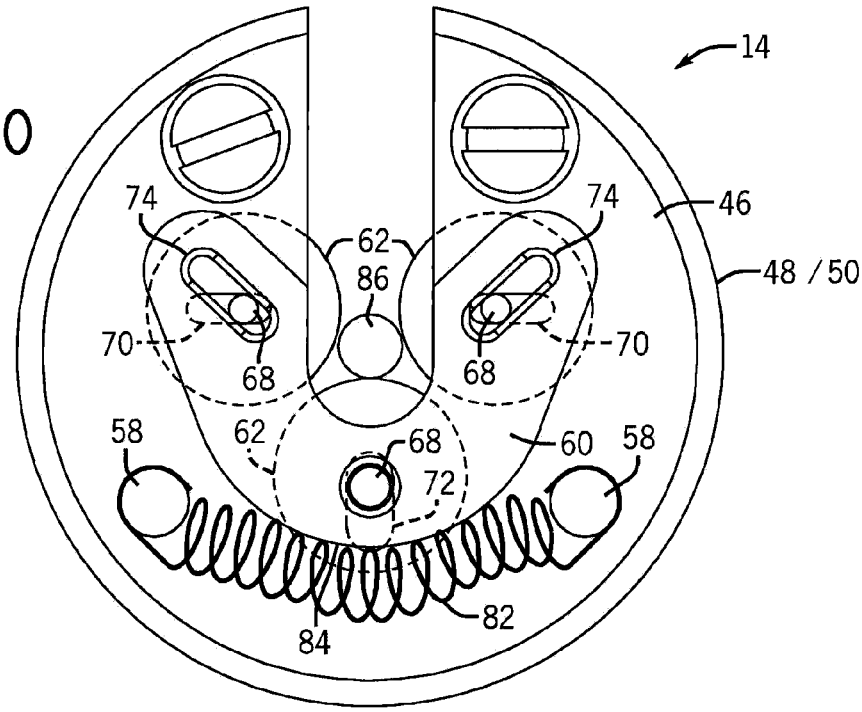
FIG. 10 is a left side view of the rotatable subassembly in which a wire of a first relatively small diameter is received between the rollers.
Figure 11:
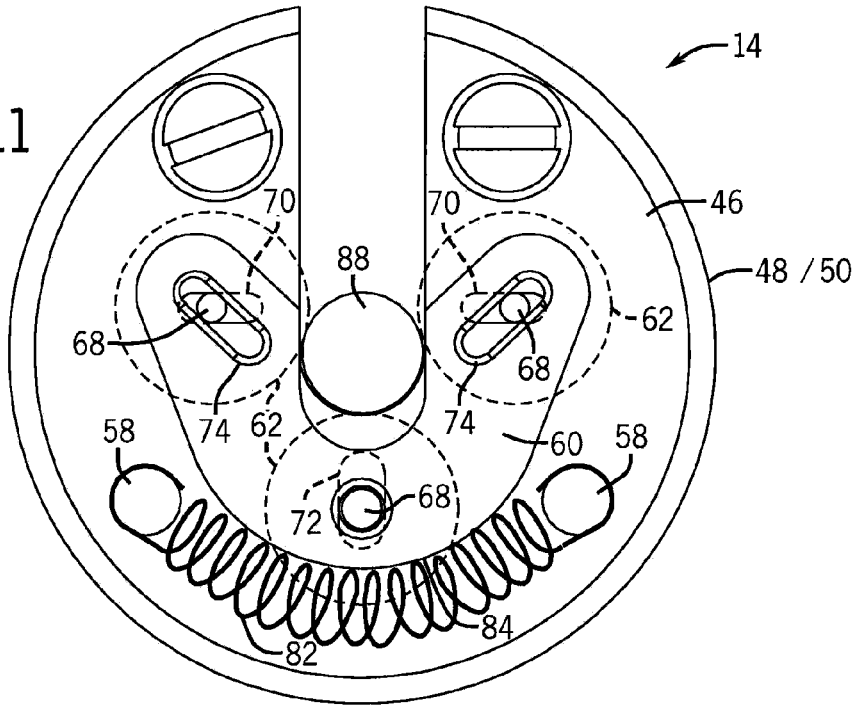
FIG. 11 is a left side view of the rotatable subassembly in which a wire of a second relatively large diameter is received between the rollers.

FIGS. 10 and 11 illustrate intermediate positions between the closed position and open position in which wires 86 and 88 of different diameters are received and clamped or captured between the plurality of rollers 62. Notably, items of variable size may be captured between the rollers 62 by first fully opening the rollers 52 to the position shown in FIG. 9 and then allowing the rollers 52 to move back toward the closed position in FIG. 8 to capture the item. Once captured, the rotatable subassembly 14 may be rotated using the drive mechanism 12, such that a label or other item may be wrapped around the centrally captured wire or object.

One potential advantage of the disclosed structure is that, the rollers 62 can perform multiple functions simultaneously which had previously required separate machine components for each separate function. Because the rollers 62 occupy a significant width between the supports 46, when an object (such as a wire) is captured between the rollers 62, this object is contacted over the entire width of the rollers 62. This means that the rollers 62 can simultaneous straighten the wire over the roller length, center the wire in the rotational assembly 14, and apply a force over the length of the wire during wrapping.

It should be appreciated that in other embodiments, the wrapper assembly may be designed to accommodate other non-cylindrical objects. In this case, it may be preferable that there be additional rollers with independent suspensions that conform the shape of the object to ensure that the item is securely held for rotation of the wrapper around the item.

Thus, a wrapper assembly is disclosed that has many advantages that are unknown in other wrappers. The rollers can simultaneously straighten, center, and apply a clamping force to the wire or other object. In other devices, separate components may be necessary to perform all of these functions. Additionally, the rotatable assembly is centered about the axis of rotation and it is not required that another assembly orbit about the centrally disposed wire, as is the case in some other devices. This provides the benefit of not having to provide elaborate or dynamic centering devices which must first establish the location of the wire and then be capable of orbiting around the wire. Moreover, because no orbiting occurs, the wrapper assembly is very compact and does not need additional clearance for orbiting components. Among other things, this more compact design makes the disclosed device particularly well-suited for use in portable devices.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

What is claimed is:

1. A wrapper assembly comprising:

a pair of supports spaced apart from one another, each of the pair of supports having positioning slots formed therein;

a plurality of rollers disposed between the pair of supports and supported by the positioning slots in the pair of supports, the plurality of rollers having axes that are substantially parallel with one another; and at least one yoke having positioning slots formed therein that support at least some of the plurality of rollers, the at least one yoke being movable relative to the pair of supports to shift the positioning slots in the at least one yoke relative to the positioning slots in the at least one of the pair of supports to thereby alter a position of at least some of the plurality of rollers relative to one another;

wherein the pair of supports, the plurality of rollers, and the at least one yoke comprise a rotatable subassembly.

2. The wrapper assembly of claim 1, wherein the plurality of rollers are movable between a closed position and an open position.

3. The wrapper assembly of claim 2, wherein the plurality of rollers are configured to capture an object centrally disposed there between when the plurality of rollers are between the closed position and the open position.

4. The wrapper assembly of claim 2, further comprising at least one biasing element that engages the at least one yoke and wherein the biasing element is configured to bias the at least one yoke towards the closed position.

5. The wrapper assembly of claim 4, wherein the biasing element is an extension spring.

6. The wrapper assembly of claim 1, further comprising a frame into which the rotatable subassembly is received and wherein the rotatable subassembly is rotatable relative to the frame about a rotational axis.

7. The wrapper assembly of claim 6, wherein the pair of supports are discs.

8. The wrapper assembly of claim 7, wherein each of the pair of supports include a notch that generally extends from a center of the support to a periphery of the support and the at least one yoke includes a notch.

9. The wrapper assembly of claim 8, wherein the frame includes at least one opening that aligns with the notch in at least one rotation position of the rotatable subassembly in the frame thereby allowing the insertion of an item into the rotatable subassembly.

10. The wrapper assembly of claim 6, wherein the rotatable subassembly further comprising a worm wheel coupled thereto and wherein the wrapper assembly further comprises a worm gear configured to drive the worm wheel thereby causing the rotation of the rotatable subassembly.

11. The wrapper assembly of claim 1, further comprising a plurality of spacers coupling the pair of supports to one another.

12. The wrapper assembly of claim 1, wherein the wire wrapper includes a pair of yokes, with one of the pair of yokes being disposed proximate to each end of the plurality of rollers.

13. The wrapper assembly of claim 1, wherein at least some of the plurality of rollers include dowel rods extending from their axial ends and wherein the dowel rods are received in the positioning slots of the pair of supports and the at least one yoke.

14. The wrapper assembly of claim 1, wherein:

the positioning slots on each of the pair of supports includes a pair of collinear slots and a slot that is perpendicular to the pair of collinear slots; and the at least one yoke includes a pair of linear slots that are at an angle relative to one another.

15. The wrapper assembly of claim 14, wherein the pair of collinear slots in the pair of supports and the pair of linear slots that are at an angle relative to one another in the at least one yoke form a pair of intersections that thereby define axes for two of the plurality of rollers.

16. The wrapper assembly of claim 15, wherein one of the pair of rollers is configured to translationally move with the at least one yoke and be supported by the slot that is perpendicular to the pair of collinear slots.

17. The wrapper assembly of claim 16, wherein there are three rollers and the positional slots are configured such that, when the at least one yoke is moved to alter the axes of the three rollers relative to one another along a plane that is perpendicular to the axes of the three rollers, circles having a circumference defined by the intersection of the axes with the plane will be concentric with one another.

18. A wrapper assembly comprising:

a frame;

a rotatable subassembly received in the frame, the rotatable subassembly being rotatable relative to the frame about a rotational axis, the rotatable subassembly comprising:

a pair of discs spaced apart from one another, each of the pair of discs having positioning slots formed therein and each of the pair of discs include a notch that generally extends from a center of the disc to a periphery of the disc;

a plurality of rollers disposed between the pair of discs and supported by the positioning slots in the pair of discs, the plurality of rollers having axes that are substantially parallel with one another; and a pair of yokes having positioning slots formed therein that support at least some of the plurality of rollers, the pair of yokes being movable relative to the pair of discs to shift the positioning slots in the pair of yokes relative to the positioning slots in the a corresponding one of the pair of discs to thereby alter a position of at least some of the plurality of rollers relative to one another.

* * * * *